US005458021A

United States Patent [19]

Wichelt et al.

[11] Patent Number: 5,458,021

[45] Date of Patent: Oct. 17, 1995

[54] CONTROL LEVER NEUTRAL LOCK MECHANISM

[75] Inventors: Kent M. Wichelt, Brownstown; Jack K. Braine, Mohnton, both of Pa.

[73] Assignee: New Holland North America, Inc., New Holland, Pa.

[21] Appl. No.: 160,139

[22] Filed: Dec. 2, 1993

[51] Int. Cl.[6] ..... G05G 5/04

[52] U.S. Cl. ..... 74/536; 74/528; 74/529; 74/545; 74/532

[58] Field of Search ..... 74/528, 529, 501.6, 74/543, 545, 532, 536, 535; 188/265

[56] References Cited

U.S. PATENT DOCUMENTS

| | | | |
|---|---|---|---|
| 963,930 | 6/1909 | Olson | 74/536 |
| 2,246,919 | 7/1940 | Krantz | 74/532 |
| 2,427,804 | 9/1947 | Mueller | 74/536 |
| 2,900,836 | 9/1958 | Gleeson et al. | 74/532 |
| 4,116,086 | 9/1978 | Langford et al. | 74/532 |
| 4,522,394 | 6/1985 | Brovsgard | 74/528 |
| 4,548,094 | 10/1985 | Huitema | 74/526 |
| 4,942,949 | 7/1990 | Dai | 188/265 |
| 5,150,592 | 9/1992 | Lin | 74/528 |

*Primary Examiner*—Rodney H. Bonck
*Assistant Examiner*—David M. Fenstermacher
*Attorney, Agent, or Firm*—Larry W. Miller; Frank A. Seemar

[57] ABSTRACT

A guide mechanism for controlling the pivotal positioning of a hydraulic control lever on tractors is disclosed wherein the guide mechanism incorporates a positive neutral lock in the form of a tab that is projectable into an opening within the control lever that is alignable therewith when in a neutral position. The guide mechanism includes a thumb wheel portion that projects upwardly through the control panel for manipulation by the operator for selectively rotating the guide mechanism to align a slotted opening therein with the control lever to limit the movement thereof in a preselected manner. The guide member is rotatable to four orientations to correspond to a neutral lock position, a float lockout position, a hydraulic motor mode position, and an unrestricted free range of movement position for the control lever.

6 Claims, 5 Drawing Sheets

CONTROL LEVER NEUTRAL LOCK MECHANISM

BACKGROUND OF THE INVENTION

This invention relates generally to control levers used on machinery such as agricultural tractors to operate hydraulic devices and, more particularly, to a mechanism cooperable with the control lever to limit the movement thereof and, thereby, restrict the operation of the corresponding hydraulic device.

One rotatable control lever position control apparatus is disclosed in U.S. Pat. No. 4,548,094, issued to Thomas W. Huitema, et al, on Oct. 22, 1985. This apparatus is in the form of a cylinder having notches formed therein to engage the control lever passing therethrough and limit the movement of the control lever in accordance with the notch aligned with the control lever. The cylinder is provided with a thumb wheel member that projects upwardly through the control panel for rotation by the operator to select the respective notch to be aligned with the control lever.

It is desirable to provide an alternative control lever position control mechanism having a more positively engageable neutral lock to restrain the actuation lever in a neutral position to prevent accidental actuation of the corresponding hydraulics system. For example, the tractor could have an implement attached to the rear of the tractor and coupled to the remote hydraulic ports controlled by one of the actuation levers. Such a positive neutral lock would permit the transport of the implement without fear of engaging the operation of the implement during transport through an accidental bumping of the control lever in the operator's cab.

Such a control lever position control mechanism must also be operable through manipulation by the operator to limit the movement of the control lever in different selectable configurations to allow the operator to select the various modes of operation of the hydraulic system. Many hydraulic control levers are operable through four positions, raise, neutral, lower and float positions. The control lever position control mechanism can limit movement of the control lever to certain of these positions to correspond to traditional operations of the hydraulic system.

SUMMARY OF THE INVENTION

It is an object of this invention to provide a hydraulic control lever position control mechanism that incorporates a positive neutral lock operation to restrain the control lever in its neutral position.

It is another object of this invention to provide a position control mechanism that enables a greater variety of operative modes for the operation of the associated hydraulic system.

It is a feature of this invention to provide a hydraulic lever position control mechanism that provides the functions of a neutral lock, a float lockout, a lock into a hydraulic motor mode, and an unrestricted free range of movement of the control lever.

It is an advantage of this invention that the position control mechanism provides four separate functions of operation of the corresponding hydraulic system through a pivotal actuating lever movable between three positions.

It is another advantage of this invention that the operator can positively orient the position control mechanism in a selected orientation for selection of the desired function of the associated hydraulic system.

It is further object of this invention to provide a position control mechanism cooperable with a tractor hydraulic control lever which is durable in construction, inexpensive of manufacture, carefree of maintenance, facile in assemblage, and simple and effective in use.

These and other objects, features, and advantages are accomplished according to the instant invention by providing a guide mechanism for controlling the pivotal positioning of a hydraulic control lever on tractors wherein the guide mechanism incorporates a positive neutral lock in the form of a tab that is projectable into an opening within the control lever that is alignable therewith when in a neutral position. The guide mechanism includes a thumb wheel portion that projects upwardly through the control panel for manipulation by the operator for selectively rotating the guide mechanism to align a slotted opening therein with the control lever to limit the movement thereof in a preselected manner. The guide member is rotatable to four orientations to correspond to a neutral lock position, a float lockout position, a hydraulic motor mode position, and an unrestricted free range of movement position for the control lever.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
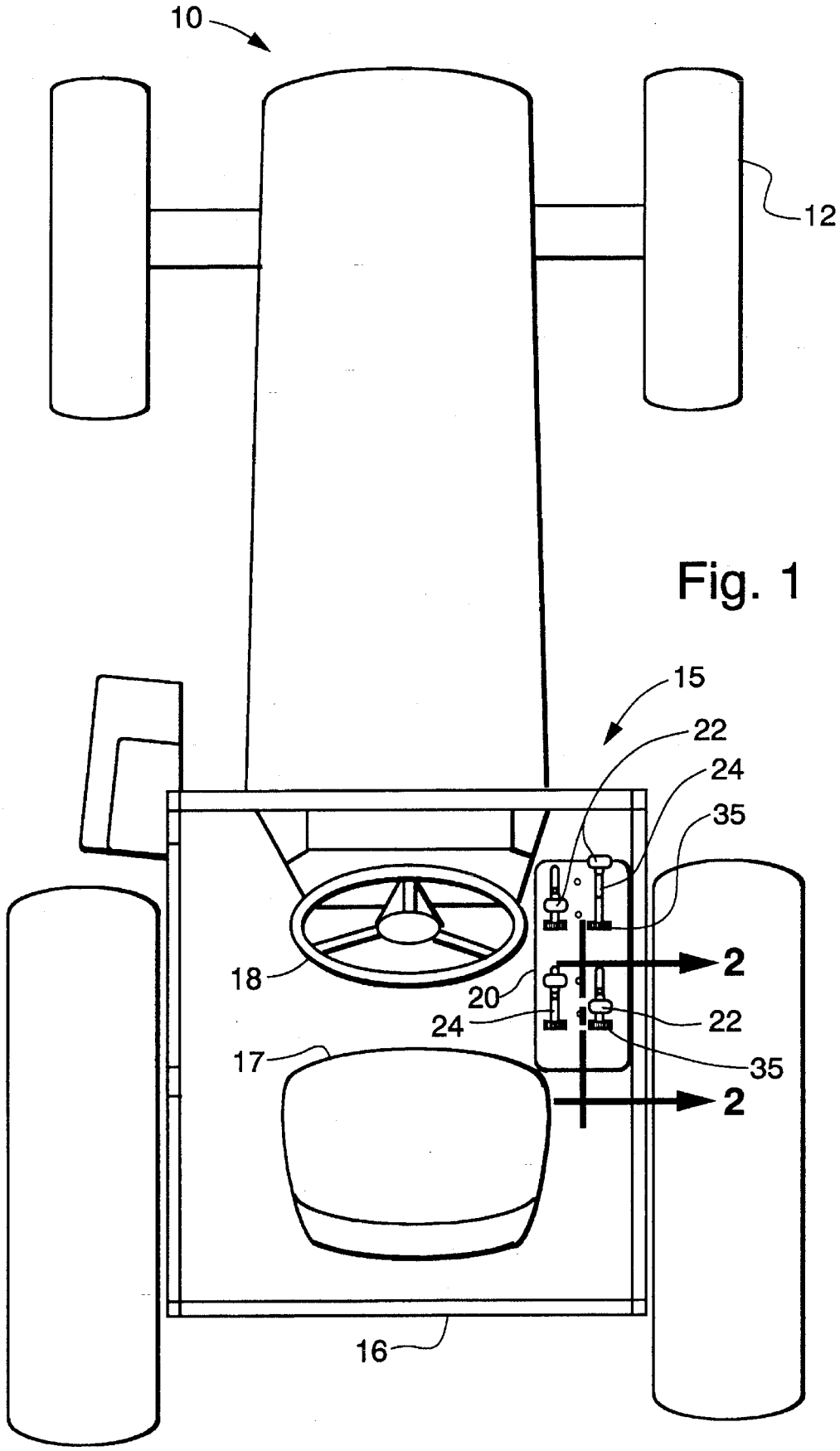
FIG. 1 is a schematic top plan view of a tractor incorporating the principles of the instant invention, the tractor being provided with an operator's station including a multi-lever control panel for operating various tractor hydraulic devices.
Figure 2:
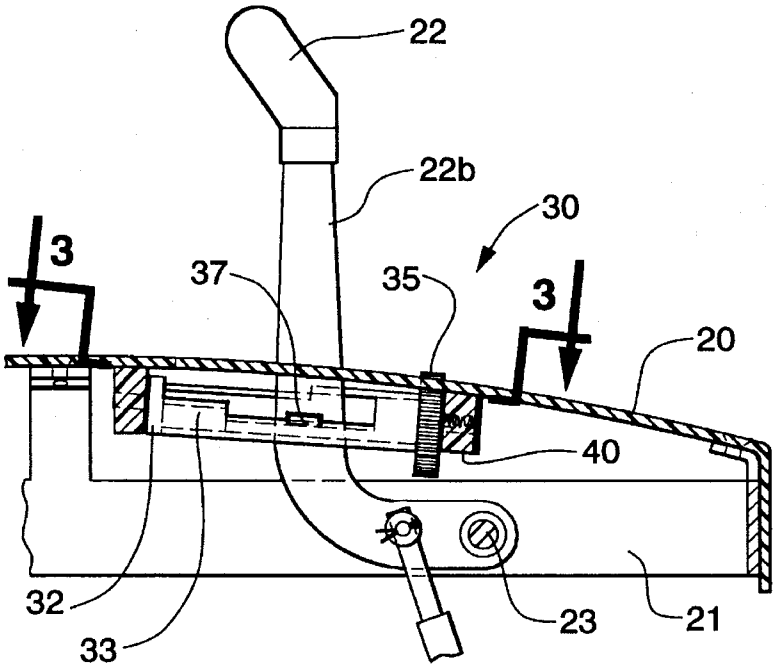
FIG. 2 is a partial cross-sectional view of a portion of the control panel to depict an elevational view of a representative control lever corresponding to lines 2—2 of FIG. 1 with the control lever being locked into a neutral mode by the guide member.
Figure 2A:
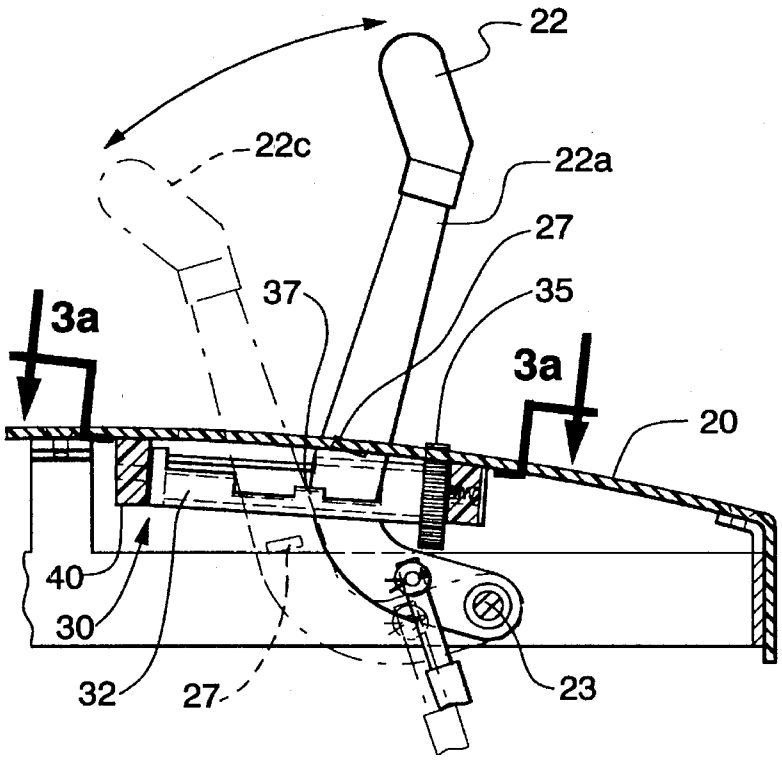
FIG. 2*a* is a partial cross-sectional view similar to that of FIG. 2 showing a representative control lever being restrained in a float lockout position by the guide member.
Figure 2B:
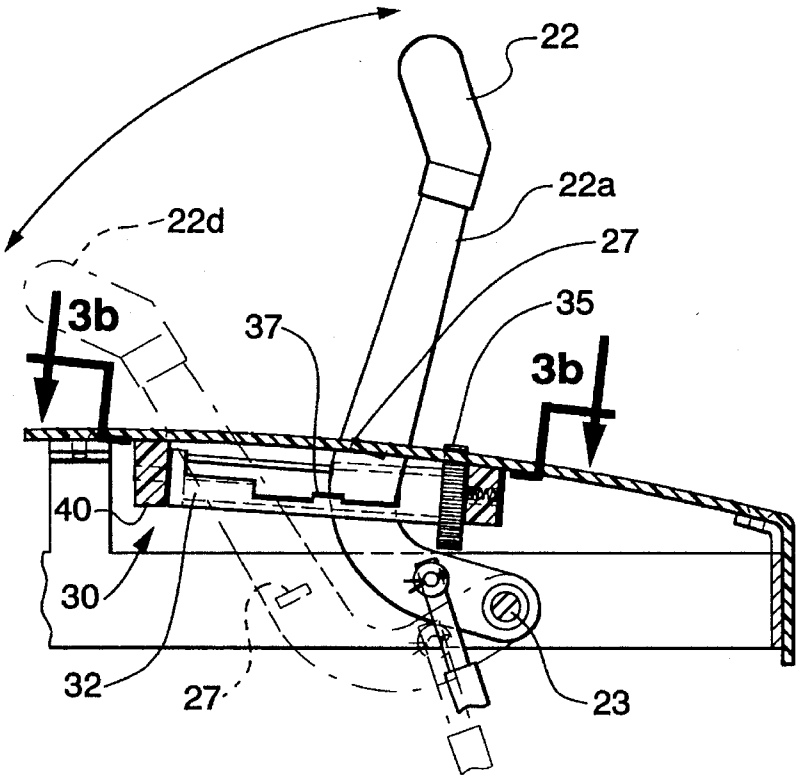
FIG. 2*b* is a partial cross-sectional view similar to that of FIG. 2 showing a representative control lever being permitted to operate through the entire range of movement permitted the control lever by the guide member.

Referring now to FIG. 1, a representative schematic tractor can best be seen. The tractor 10 includes a wheeled chassis 12 supporting an operator's station 15 in a conventional manner. The operator's station 15 may include an enclosed operator cab 16 in which is positioned a seat 17, conventional steering mechanism 18 and a control panel 20 within arm's reach of the seat 17. The control panel 20 is typically provided with several control levers 22 projecting upwardly through the control panel 20 for manipulation thereof by the operator to control various conventional hydraulic devices (not shown) known to be incorporated into modern tractors 10.

Referring in addition now to FIGS. 2*a*—3*d*, the details of the position control mechanism 30 can best be seen. The representative control lever 22 is pivotally supported by a first pivot 23 carried by the subframe 21 of the control panel 20 for movement in a fore-and-aft direction. The control panel 20 is provided with a first slotted opening 24 therein to accommodate this pivotal movement of the control lever 22. The position control mechanism 30 includes a guide member 32 supported from the control panel 20 at a location through which the control lever 22 passes through it.

The guide member 32 is formed in a cylindrical configuration having a body portion 33 defining openings permitting the passage of the control lever 22 therethrough. The body portion 33 is configured in such a manner as to define slots limiting the linear movement of the control lever 22 in a manner described in greater detail below. The guide member 32 is rotatable about a longitudinal axis that is aligned with the linear path of movement of the control lever 22 as it moves from one position to the other. The body portion 33 of the guide member 32 is supported beneath the top surface of the control panel 20. An integral knurled thumb-wheel 35 extends from the body portion 33 and projects through an opening in the control panel 20 for manipulation by the operator.

The control lever 22 is movable between four operating positions. The rearwardmost position 22*a* corresponds to a "raise function" in which the hydraulic fluid within the hydraulic system associated with the control lever 22 is permitted to flow in a first direction, typically to effect a raising of an implement attached to the tractor. The primary intermediate position of the lever 22 is the neutral position 22*b* in which the hydraulic fluid within the associated hydraulic system is prevented from flowing through the system and doing any work.

The primary forward position 22*c* of the lever 22 corresponds to a "lower function" in which the hydraulic fluid within the hydraulic system associated with the control lever 22 is permitted to flow in a second direction opposite to the "raise function", typically to effect a lowering of an implement attached to the tractor. The forwardmost operating position 22*d* corresponds to a "float function" in which the hydraulic fluid is permitted to flow through the hydraulic system in either the first or second directions. The "float function" is associated with a conventional detent mechanism in the hydraulic system to lock the system in this operation until the lever 22 is physically moved from this position.

The guide member 32 is rotatable in a selected one of four orientations to limit the extent of linear movement of the control lever 22. In the first orientation, the guide member 32 is operable to lock the control lever 22 in the neutral position 22*b*. A tab 37 projecting outwardly from the body portion 33 is engageable with a hole 27 in the control lever 22 to restrict the linear movement of the lever 22 to any other position other than the neutral position 22*b*. The second orientation of the guide member 32 retracts the tab 37 from the hole 27 in the lever 22 and permits the lever to be moved between the raise position 22*a* and the lower position 22*c*. This second orientation can be referred to as a "float lockout" position because the guide member 32 prevents the control lever 22 from being movable into the float position 22*d*.

The third orientation of the guide member 32 allows the control lever 22 to be moved to any of the positions 22*a*, 22*b*, 22*c*, 22*d*. The fourth orientation of the guide member 32 can be referred to as the "hydraulic motor mode" in which the control lever 22 is permitted to move between the lower position 22C and the float position 22*d*. This hydraulic motor mode allows the hydraulic system to work a hydraulic motor, which generally operates in a single direction or is placed in an non-operating condition. The placement of the control lever 22 in the lower position directs the hydraulic fluid in a fixed direction to operate the hydraulic motor, i.e. placing the hydraulic motor in an "on" condition. Pushing the control lever 22 to the float position effectively turns the hydraulic motor "off" or places it in a neutral condition since the hydraulic fluid is not forced through the system in any direction.

Referring now to all the Figures, it will be seen that the preferred embodiment of the instant invention is to assemble two of the guide members 32, to correspond to adjacent hydraulic levers 22 on the control panel 20, into a carrier 40 for rotational movement about parallel axes. This carrier 40 can be bolted to the top cover of the control panel 20 such that the pair of adjacent control levers 22 extend upwardly through the respective guide members 32 and the corresponding thumb-wheels 35 project upwardly through the top cover of the control panel 20 adjacent the hydraulic levers 22 for access by the operator.

Figure 3:
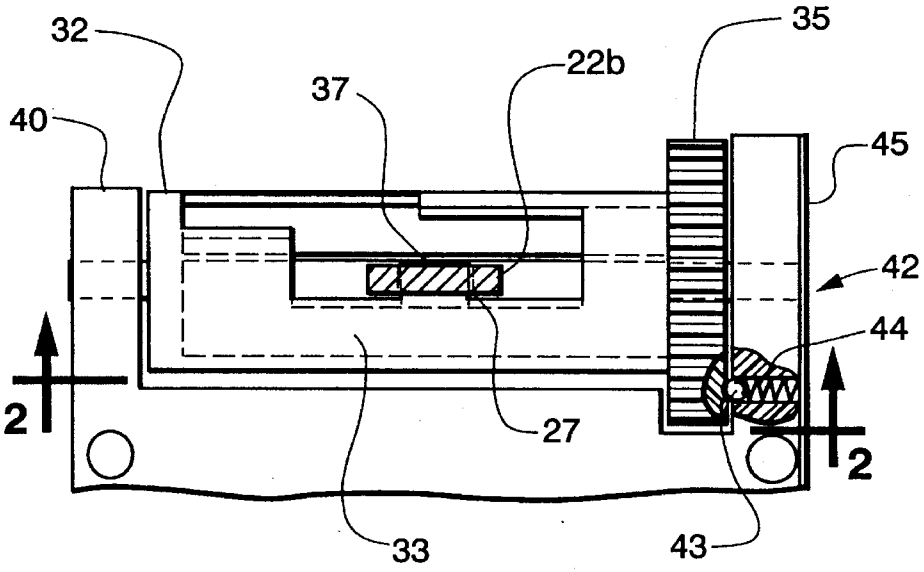
FIG. 3 is a top plan view of the representative control lever corresponding to lines 3—3 of FIG. 2 with the control lever being locked into a neutral mode by the guide member.
Figure 3A:
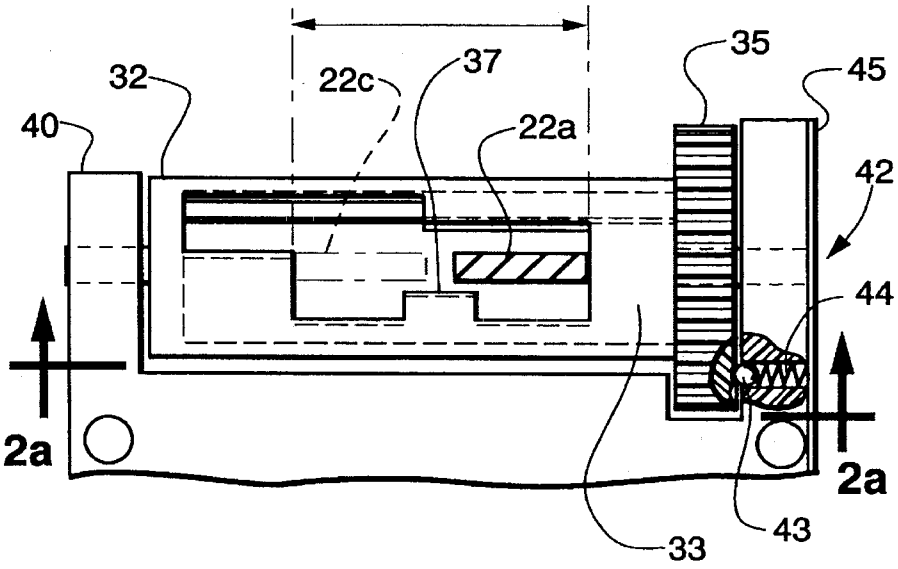
FIG. 3*a* is a top plan view similar to that of FIG. 3, but corresponding to lines 3*a*—3*a* of FIG. 2*a*, showing a representative control lever being restrained in a float lockout position by the guide member.
Figure 3B:
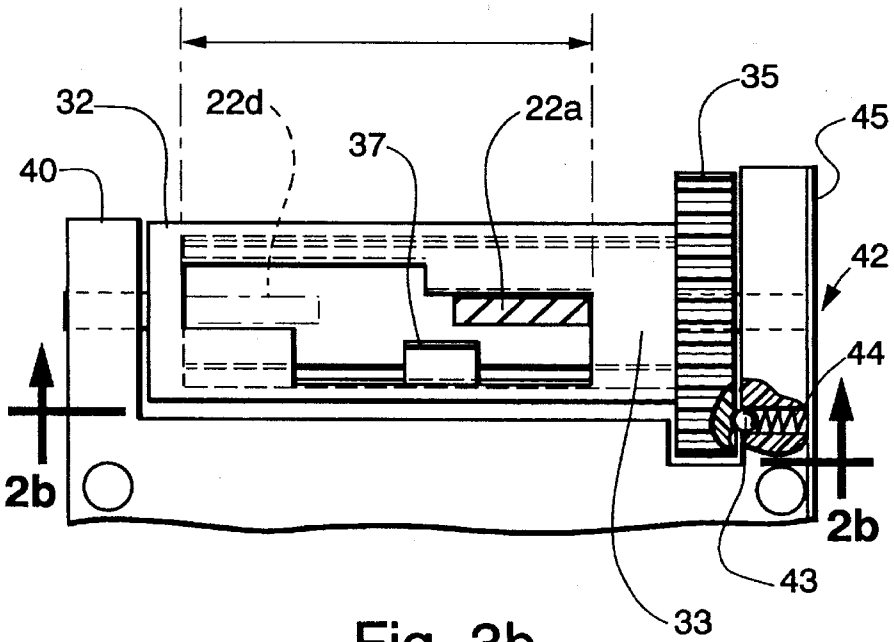
FIG. 3*b* is a top plan view similar to that of FIG. 3, but corresponding to lines 3*b*—3*b* of FIG. 2*b*, showing a representative control lever being permitted to operate through the entire range of movement permitted the control lever by the guide member.
Figure 3C:
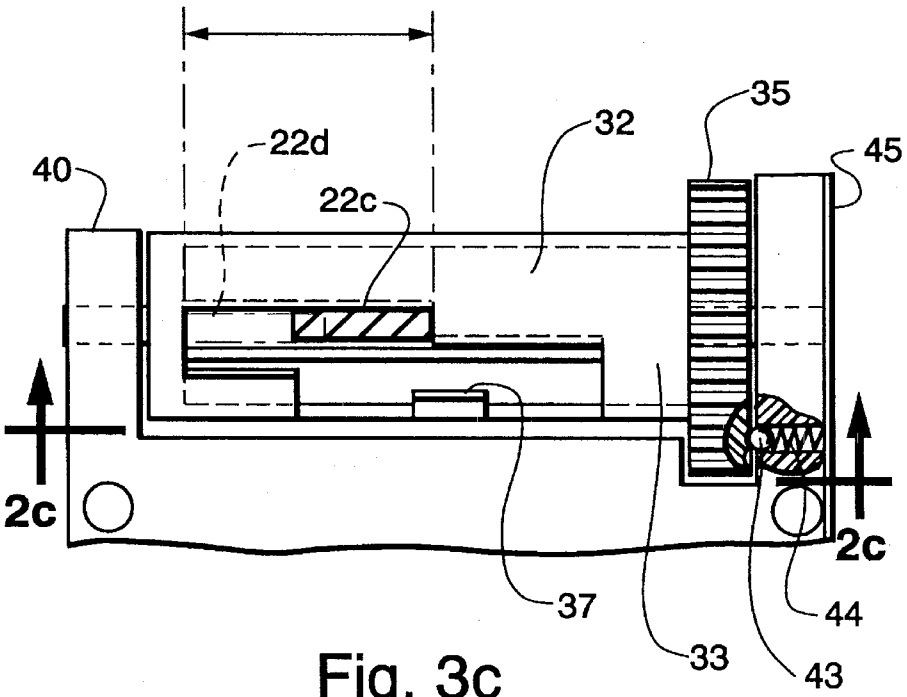
FIG. 3*c* is a top plan view similar to that of FIG. 3, but corresponding to lines 3*c*—3*c* of FIG. 2*c*, showing a representative control lever being restricted in a hydraulic motor mode by the guide member.
Figure 2C:
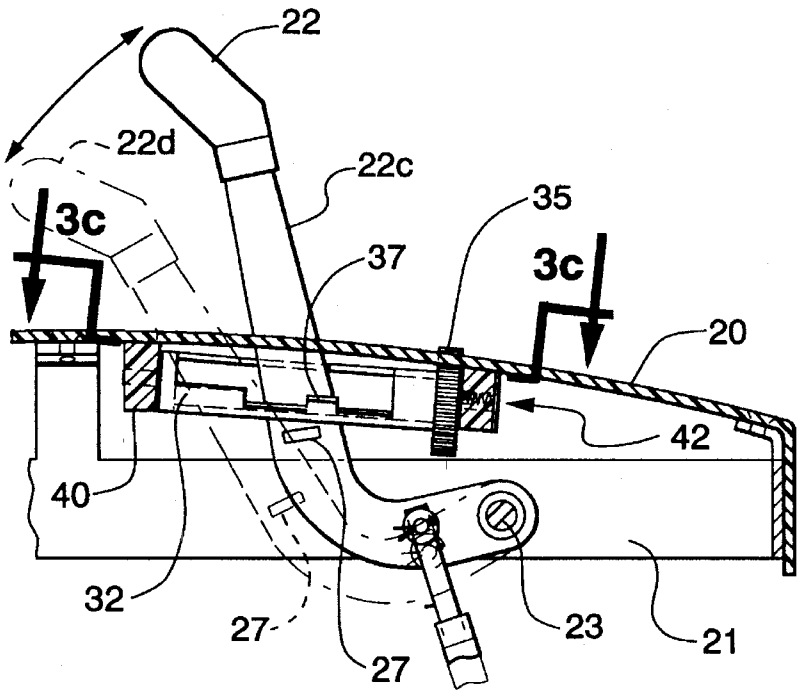
FIG. 2*c* is a partial cross-sectional view similar to that of FIG. 2 showing a representative control lever being restricted in a hydraulic motor mode by the guide member.

Each carrier 40 further includes a detent mechanism 42 associated with each respective guide member 32 to retain the guide member 32 in the selected orientation. As best shown in the broken away portions of FIGS. 3 through 3*c*, the detent mechanism 42 includes a ball 43 urged against the corresponding thumb-wheel 35 by a spring 44 compressed between the ball 43 and a retention plate 45 supported on the carrier 42. The ball 43 is receivable within one of four detent depressions 47 to restrain the guide member 32 from free movement from one orientation to another. The spring 44 will yield upon manipulation of the thumb-wheel to allow the ball 43 to retract from the detent depression 47 and re-engage with the detent depression 47 corresponding to the selected orientation of the guide member.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. In a tractor having a mobile frame; an operator's station supported on said frame; at least one pivotally mounted control lever movable to a first position for effecting a first operation of a remote device, a second position for effecting a second opposing operation of said remote device, and a neutral position in which said remote device is placed in a neutral position that effects neither of said first and second operations; a guide member rotatable about an axis of rotation and being cooperable with a corresponding one of said control levers to limit the range of movement of said corresponding control lever to preselected positions, said guide member being operable to restrain said control lever in said neutral position when oriented in a neutral lock orientation; and power means supported on said frame to provide operative power for the movement of said mobile frame, an improved guide member comprising:

a cylindrical body having a plurality of adjacent elongated slots formed therein through which the corresponding said control lever passes, said cylindrical body being rotatable about said axis of rotation to align a selected one of said elongated slots with the corresponding said control lever to limit movement thereof in a predetermined manner; and further having a tab projecting generally perpendicularly to said axis of rotation of said guide member, said tab being engageable with an alignable hole in the corresponding said control lever when said guide member is oriented in said neutral lock position to prevent movement of said corresponding control lever to any other position.

2. The tractor of claim 1 wherein said tab is rotated outside the path of movement of said control lever when said guide member is oriented other than in said neutral lock position to align said corresponding control lever with one of said elongated slots.

3. The tractor of claim 1 wherein each said control lever is positionable in a float position, each said guide member being rotatable to a float lockout orientation in which the corresponding said elongated slot restricts the movement of the corresponding said control lever from being positioned in said float position.

4. The tractor of claim 3 wherein said guide member is rotatable to a hydraulic motor mode orientation in which the corresponding said elongated slot restricts the movement of the corresponding said control lever only between said float position and said second position.

5. The tractor of claim 1 wherein said control lever is pivotally mounted on a pivot axis extending generally perpendicularly to the axis of rotation of said guide member, said control lever being movable about said pivot axis when moving from one position to another is such a manner that the hole therein is vertically movable relative to the axis of rotation of said guide member when moving from one position to another.

6. The tractor of claim 5 wherein said tab is alignable with said hole in said control lever only when said control lever is in said neutral position.

* * * * *